US005799413A

United States Patent [19]

Argyris

[11] Patent Number: 5,799,413

[45] Date of Patent: Sep. 1, 1998

[54] INNERSOLE FOR A SHOE AND METHOD OF MAKING THE SAME

[76] Inventor: Art Argyris, 1415 Montezuma Way, West Covina, Calif. 91791

[21] Appl. No.: 852,963

[22] Filed: May 8, 1997

[51] Int. Cl.[6] ..... A43B 13/38; A43B 7/08

[52] U.S. Cl. ..... 36/43; 36/3 R; 36/3 B; 36/44; 36/141

[58] Field of Search ..... 36/3 R, 3 A, 3 B, 36/43, 44, 71, 141

[56] References Cited

U.S. PATENT DOCUMENTS

| | | | |
|---|---|---|---|
| 682,141 | 9/1901 | Galloway | 36/3 R |
| 1,010,002 | 11/1911 | Stern | 36/3 R |
| 2,309,673 | 2/1943 | Schlear | 36/43 |
| 2,461,355 | 2/1949 | Supple | 36/43 |
| 2,465,725 | 3/1949 | Herzmark | 128/25 |
| 2,581,864 | 1/1952 | Kaufmann, Jr. | 36/43 |
| 2,820,454 | 1/1958 | Wright | 128/25 |
| 3,681,797 | 8/1972 | Messner | 5/347 |
| 4,045,886 | 9/1977 | Terasaki | 36/44 |
| 4,095,353 | 6/1978 | Foldes | 36/11.5 |
| 4,173,216 | 11/1979 | Nolet | 128/24.1 |
| 4,215,492 | 8/1980 | Sandmeier | 36/44 |
| 4,224,746 | 9/1980 | Kim | 36/3 B |
| 4,329,981 | 5/1982 | Dungl | 128/25 B |
| 4,509,510 | 4/1985 | Hook | 128/25 R |
| 4,674,203 | 6/1987 | Goller | 36/44 |
| 4,841,647 | 6/1989 | Turucz | 36/44 |
| 4,910,882 | 3/1990 | Goller | 36/3 B |
| 5,035,068 | 7/1991 | Biasi | 36/3 R |
| 5,106,161 | 4/1992 | Meiller | 297/453 |
| 5,551,173 | 9/1996 | Chambers | 36/44 |

FOREIGN PATENT DOCUMENTS

| | | | |
|---|---|---|---|
| 0100067 | 2/1984 | European Pat. Off. | 36/43 |
| 2095495 | 1/1972 | France . | |
| 1991909 | 4/1968 | Germany . | |
| 2024534 | 12/1971 | Germany | 36/43 |
| 3308731 | 9/1984 | Germany | 36/25 R |
| 3344536 | 6/1985 | Germany | 36/43 |
| 8506415 | 6/1985 | Germany . | |
| 3714795 | 11/1988 | Germany . | |

*Primary Examiner*—M. D. Patterson
*Attorney, Agent, or Firm*—Oppenheimer Wolff & Dohnelly LLP

[57] ABSTRACT

An innersole for insertion into a shoe having a base of a flexible material with an upper and lower surface with a plurality of spaced rows of lugs extending upwardly from the upper surface. Each of the lugs has a base portion and a rounded top portion and an elongated axis. A cover is disposed over the upper surface of the base covering the lugs forming an undulating surface on the base and fixedly secured to the lugs and the upper surface of the base with no spacing between the cover, the lugs, and the upper surface of the base. A plurality of perforations are provided, each of the perforations extending through the cover, each of the lugs along generally the longitudinal axis thereof, and through the base. A plurality of spaced grooves may be provided on the underside of the base.

8 Claims, 2 Drawing Sheets

FIG. 2
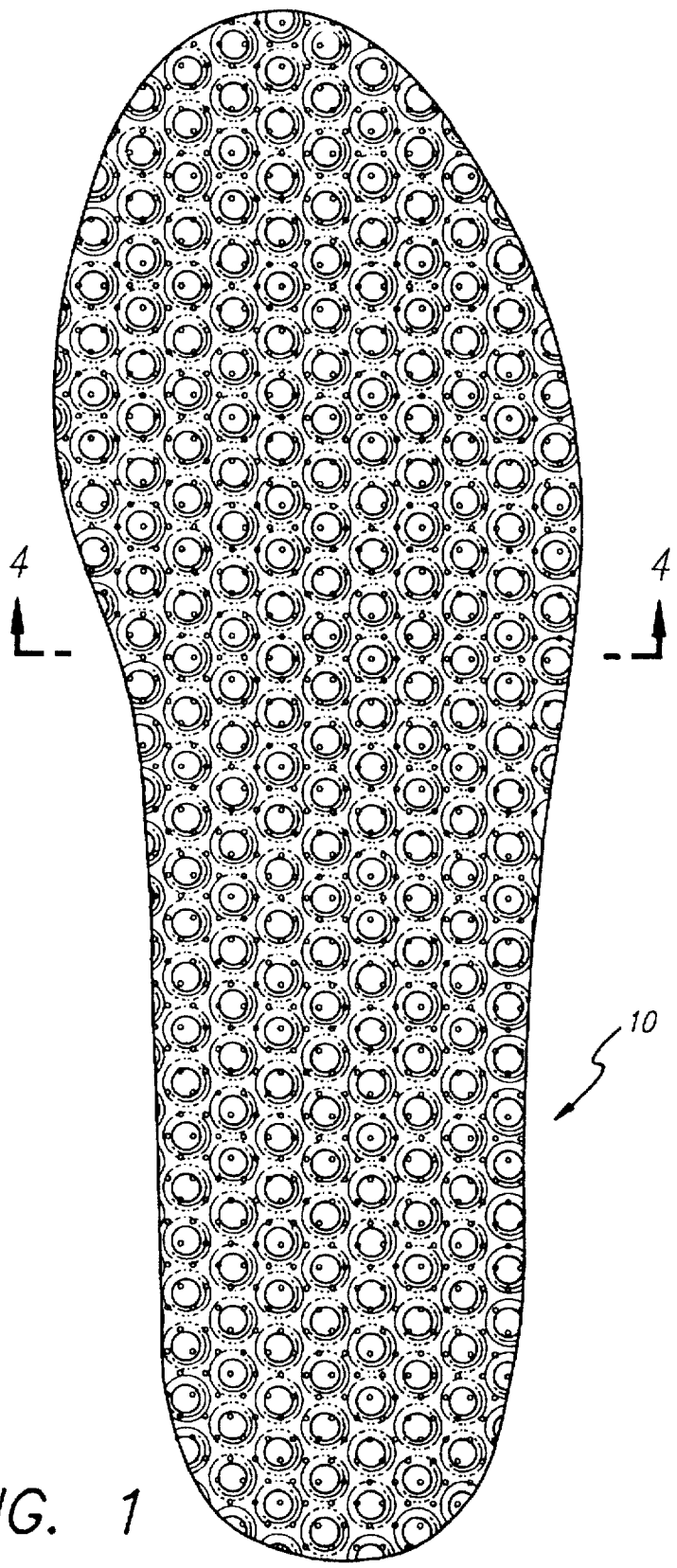
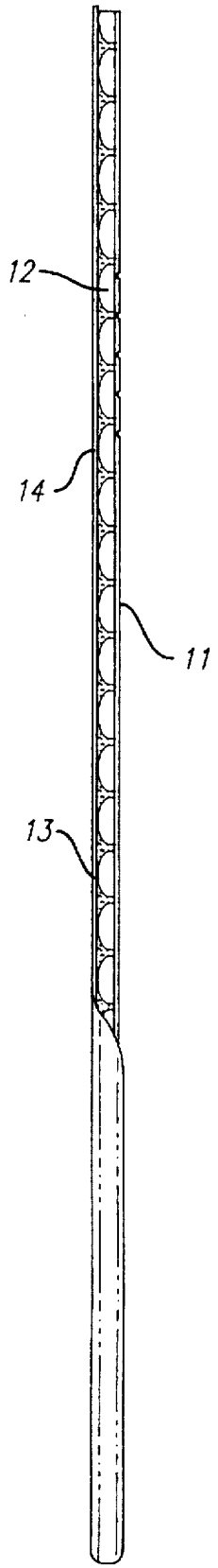
FIG. 1

INNERSOLE FOR A SHOE AND METHOD OF MAKING THE SAME

BACKGROUND OF THE INVENTION

1. Field of the Invention

The invention relates to innersoles; and, more particularly, to the inner part of a shoe in the form of an insert sole or innersole as a foot support.

2. Background Information

Shoes and sandals with foot support are well known in the art. They are worn by people whose feet are subjected to a lot of strain.

In order to achieve a better blood circulation through the feet, so-called massage-sandals are also known, for instance from U.S. Pat. No. 4,095,353 or U.S. Pat. No. 3,722,113. These sandals have a surface formed of a plurality of plastic lugs with rounded-off tops. In these, the massage effect and also the aeration of the soles of the feet is pleasurable to the user.

One shoe design in European patent application EP No. 100 067-A, which has an inner sole supported by the walking sole. The upper surface of the inner sole is adapted to the anatomical shape of the foot. It has a series of elevations with rounded heads. A covering from fabric or leather is stretched over the inner sole and is glued with the back side of the inner sole. The elevations are arranged in rows parallel to the longitudinal axis of the innersole.

This type of construction of a shoe has several disadvantages. The covering has to be cut out with a wide margin. The increase expenditure of material makes the shoe more expensive. The gluing of the covering on the rear side of the inner sole requires additional work processes. When walking, the covering rubs on the elevations of the inner sole and is thus destroyed. Apart from that creases can arise in the loose covering during the walking process, which cause blisters on the feet. The aeration of the sole of the foot is impaired by the loose covering.

In German Patent. No. 2,024,534, there is disclosed a sole for a shoe having a hard cover 5 over lugs 3 forming an undulating surface with air channels between the cover, lugs, and base 1. Between the walking surface and the surface contacting the foot of the wearer, there are lugs covered by a glued-on leather piece.

This known sole has certain disadvantages. It is formed of a hard material so that it can have an adequate useful lifetime. Moreover, the lugs are also hard. As a result, the foot bears on a substructure which is hard and inelastic. Such a sole is uncomfortable for walking and difficult on the joints in the legs and hips.

In U.S. Pat. No. 4,674,203 to Golfer, there is disclosed an inner part of a shoe in the form of an insert sole or innersole as a foot support, with a substructure formed from compact or cellular structure-shaped elastic material. A plurality of knobs are arranged in rows which massage the soles of the feet, which have an approximately cylindrical base and a round head, and a covering above the knobs of fabric, smooth leather or such like. Furthermore, the invention concerns a process for fabrication of the insertable innersole.

However, in Golfer, a spacing is formed between the cover and the substructure forming air channels. Golfer's covering must be carefully applied so as to maintain these air channels to provide a cushioning effect. No glue should be applied to the substructure other than at the lugs. If Golfer's covering was pressed onto the substructure with too much pressure, no air channels would be created.

There is thus a need for an innersole that provides a cushioning effect without need for careful securement of the cover to the substructure.

SUMMARY OF THE INVENTION

It is an object of this invention to provide an improved innersole which massages the soles of the feet of a user providing a cushioning effect.

It is an object of this invention to provide such innersole having a base with spaced lugs therein and a covering over the base and lugs, secured thereto, without spacing between the covering and base.

It is a further object of this invention to carry out the foregoing object wherein a cushioning effect is provided by perforations extending through the cover, the base and each of the spaced lugs.

It is another object of this invention to provide a method for forming an innersole having a base with spaced upstanding lugs and a covering over the lugs wherein a cushioning effect is provided between the base and cover of the innersole.

These and other objects are preferably accomplished by providing an innersole having a base of a flexible material with an upper and lower surface with a plurality of spaced rows of lugs extending upwardly from the upper surface. Each of the lugs has a base portion and a rounded top portion and an elongated axis. A cover is disposed over the upper surface of the base covering the lugs forming an undulating surface on this base and fixedly secured to the lugs and the upper surface of the base with no spacing between the cover, the lugs, and the upper surface of the base. A plurality of perforations are provided, each of the perforations extending through the cover, each of the lugs along generally the longitudinal axis thereof, and through the base. A plurality of spaced grooves are formed on the underside of the base.

BRIEF DESCRIPTION OF THE DRAWING

FIG. 1 is a top plan view of an innersole in accordance with the teachings of the invention;

FIG. 2 is a cross-sectional view taking along lines 2—2 of FIG. 1;

DESCRIPTION OF THE PREFERRED EMBODIMENT

Figure 3:
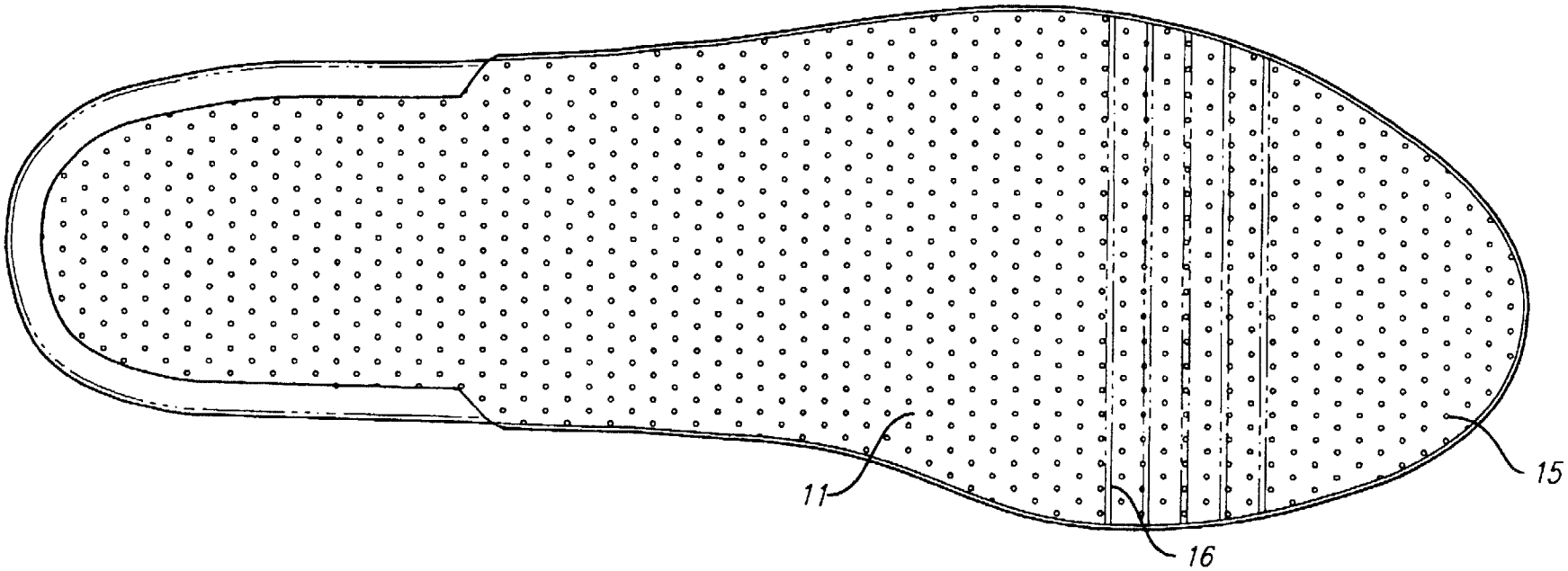
FIG. 3 is a bottom plan view of the innersole of FIGS. 1 and 2.

Referring now to FIG. 1 of the drawing, an insert or innersole 10 for a shoe is shown having a base 11 (FIG. 2) having a plurality of spaced lugs 12 molded thereon. Lugs 12 are dome-shaped having rounded heads 13. A cover 14 of smooth leather is glued over the rounded heads 13 of lugs 12 forming an undulating surface. After gluing, a plurality of perforations 15 (see FIGS. 3 and 4) are formed through cover 14, lugs 12 and base 11 providing air passageways therebetween. Finally, a plurality of spaced grooves 16 are formed on the underside of base 11, only five grooves shown in FIG. 3 of convenience of illustration.

Also as seen in FIG. 1, lugs 12 are arranged in rows, which rows cross at an angle of approximately 120° and assume an angle of approximately 60° to the longitudinal axis 18 of the innersole 10. This provides a high comfort level to the innersole due to the rolling action of one's foot when walking. Cover 14 may be applied over base 11 in any suitable manner, such as using rotating pressure rollers.

Figure 4:
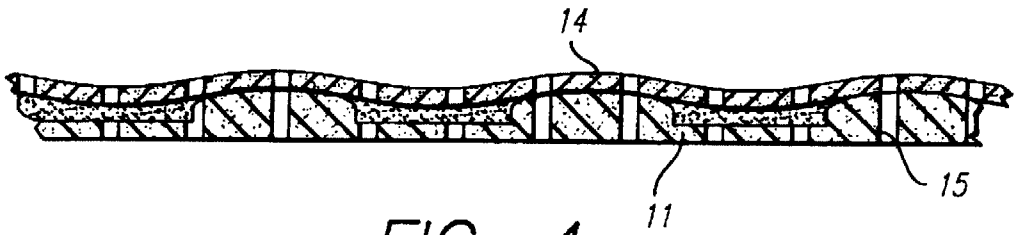
FIG. 4 is a cross-sectional view of a portion of the innersole of FIGS. 1 to 3.

As can be seen in FIG. 4, an undulating surface is formed with air channels 15 between the outside of cover 14 and the outside of base 11. Air absorbing the sweat of the user's foot is pumped through air channels 15 providing a cushioning effect. Base 11 and lugs 12 may be molded of any suitable elastic materials, such as plastic or rubber.

Adhesive is applied over the surface of base 11 and lugs 12, and cover 14 is pressed down over the tops 13 of lugs 12 sealing the same eliminating the spacing between cover 14 and the base 11. Perforations 15 are then formed through cover 14, each lug 12, and base 11. Spaced grooves are formed on the underside of base 11 either prior to gluing cover 14 or after.

The method of forming innersole 10 of the invention is simple. Glue is applied to the upper surface of base 11 completely covering the same, and thus covering the lugs too. The cover is then applied and pressed on. Rotating rollers may be used to accomplish the same and any spacing between the cover and the base is eliminated. Holes are then punched through the cover, the lug and through the base.

The lug-shaped surface presents a massage-like effect on the sole of the foot by the roll-off action when walking, whereby improved blood circulation in the feet and the legs is achieved. Simultaneously, the air aspirated through the perforations in the covering is pumped throughout the entire sole through the holes through the lugs, the covering, and the base. This should find particular application in case of blood circulation disorders in connection with cold feet. A special shock absorber effect upon the hip joint and the entire spine is achieved by means of the upholstered lug shape of the support of the sole of the foot.

Foot supports equipped in this manner should particularly find use during changes of the spine, for instance, in intervertebral disk damage and other degenerative changes, for instance, of the hip joints.

Furthermore, the joint and heel portion of the inventive inner part of the shoe may be made separately, or equipped with appropriate inserts.

Although a particular embodiment of the invention is disclosed, variations thereof may occur to an artisan and the scope of the invention should only be limited by the scope of the appended claims.

I claim:

1. An innersole for insertion into a shoe comprising:

a base having an elongated central longitudinal axis of a flexible material having an upper surface and a lower surface with a plurality or spaced rows of lugs of substantiallv identically configured lugs extending upwardly from said upper surface, each of said lugs having a base portion and a rounded top portion;

a cover disposed over the upper surface of said base covering said lugs forming an undulating surface on said base and fixedly secured to said lugs and said upper surface of said base, the spacing between said cover, said lugs and the upper surface of said base being completely filled with an adhesive material; and a plurality of perforations, each extending through said cover, said lugs, and through said base.

2. The innersole of claim 1 wherein said base is of molded plastic, said lugs are molded on said base.

3. The innersole of claim 1 wherein said cover is of leather.

4. In the innersole of claim 1 wherein said innersole is in the shape of the bottom of a foot of a user having a heel and toe portion, with a plurality of spaced grooves extending along the underside of said base.

5. The innersole of claim 1 wherein said lugs are arranged in a plurality of spaced linear rows extending generally transversely of the elongated longitudinal axis of said innersole with said rows arranged at an angle of approximately 60° to the central elongated longitudinal axis of said base on one side thereof and at an angle of approximately 120° to the central longitudinal axis of said base on the other side thereof.

6. A method of fabricating an inner part for a shoe in the shape of an insert sole or innersole comprising the steps of providing a sole-shaped elastic material substructure base having an upper surface and a lower surface with rows of lugs of substantially identical configuration in spaced relation on said upper surface and extending upwardly from the base, shaping the lugs with rounded heads spaced upwardly from the base, applying glue to the head of the lugs, and pressing a soft covering material downwardly against the heads of the lugs forming a covering over the base with the covering having a waveform configuration with crests over the lugs and depressions between the lugs with said glue completely filling the area between said covering, said base and about said lugs and perforating through said cover, through said lugs and through said base at a plurality of spaced locations after said step of pressing.

7. The method of claim 6 including the step of pressing the soft covering material against the lugs by using rotating rollers.

8. The method of claim 6 including the step of providing a plurality of spaced grooves along the underside of said base.

* * * * *